United States Patent [19]

Muccioli

[11] Patent Number: 4,922,659

[45] Date of Patent: May 8, 1990

[54] ADJUSTABLE METAL DOOR AND FRAME THEREFOR

[76] Inventor: Luigi Muccioli, Via Marchesina, 41, Trezzano sul Naviglio 20090, Italy

[21] Appl. No.: 246,294

[22] PCT Filed: Jul. 21, 1986

[86] PCT No.: PCT/IT86/00057

§ 371 Date: Jul. 14, 1988

§ 102(e) Date: Jul. 14, 1988

[87] PCT Pub. No.: WO87/04752

PCT Pub. Date: Aug. 13, 1987

[30] Foreign Application Priority Data

Jan. 31, 1986 [IT] Italy ..... 20784/86[U]

[51] Int. Cl.[5] ..... E06B 3/00

[52] U.S. Cl. ..... 49/501; 49/505

[58] Field of Search ..... 49/380, 501, 505; 52/204, 217

[56] References Cited

U.S. PATENT DOCUMENTS 2,913,777 11/1959 Viets ..... 49/505

4,319,431 3/1982 Siers ..... 49/501 X 4,517,767 5/1985 Dewson ..... 49/505 X

FOREIGN PATENT DOCUMENTS 125998 11/1984 European Pat. Off. .

437725 11/1967 Switzerland .

2126636 3/1984 United Kingdom .

*Primary Examiner*—Philip C. Kannan

*Attorney, Agent, or Firm*—Michael J. Striker

[57] ABSTRACT

A metal door assembly comprising a pair of vertically extending post members, each including a flat vertical plate having at least one vertically extending reinforcing rib, and wherein a plurality of cross-pieces project horizontally from one of the post members to be telescopically and slidably received in horizontal guide grooves of the other post member whereby the post members are able to move horizontally relative to one another, the metal door assembly further comprising upper and lower slides including each a pair of slide parts horizontally slidable relative to each other, and movable vertically relative to respective post members, and screws for securing the post members and slides relative to one another.

10 Claims, 2 Drawing Sheets

ADJUSTABLE METAL DOOR AND FRAME THEREFOR

BACKGROUND OF THE INVENTION

This invention relates to a support structure for a metal door both the height and the width of which are adjustable, as well as to a fixed frame therefor and height and width of which are likewise adjustable.

It is known that metal doors are provided with a very rugged inner metal structure which is conveniently covered, for example, by wood panels or the like.

Such metal structures normally have a fixed size and, therefore, they should be made in accordance with door dimensions that are varied each time.

This is obviously a great disadvantage and also affects the final cost of metal door since its metal structure has to be constructed to specific demands.

Attempts have been made to make metal structures height-adjustable by performing a precutting operation on the lower part thereof but without addressing the problem of adapting them in width. Usually, a maximum height is chosen as a starting height and, if a wall opening in which a door is to be mounted, is smaller in height, some precut portions are removed from the structure so that it and the door itself fit the height of the wall opening.

This is not a satisfactory approach since it does not permit the height to be adjusted to a large extent, and the width remains a prefixed width.

SUMMARY OF THE INVENTION

The object of the present invention is to overcome the foregoing disadvantages. The object of the invention is achieved by providing a metal structure for metal doors which is adjustable both as in width so in height to a large extent so that it can be adapted to practically any size of a door wall opening.

According to the invention, there is also provided a frame, likewise adjustable in width and height and which is adapted to accommodate the metal structure or, more specifically, the metal door obtained from such a structure.

Moreover, the metal structure of the invention is also a reversible structure in that it can be made either right-handed or left-handed, so that the hinge side of the metal door can be selected according to requirements.

The metal structure for metal doors in accordance with the invention is characterized in that it includes a pair of substantially vertically extending upright elements one of which is associated with a post member carrying hinge means, and the other one is associated with a post member carrying lock means. These elements are able to slidably move horizontally with respect to one another and include means that provides for mutual interengagement. This means is provided at the top and the bottom of the elements and include pairs of slides which are vertically slidable relative to the elements. The two slides of each pair are also able to move in an horizontal plane with respect to one another.

More particularly, the two upright elements, in addition to being associated with respective post members, are also associated with metal plates which at least partially overlap one another and which are provided with reinforcing cross-pieces.

The upper and lower slides include respective post pieces which are at least partially accommodated in the post members associated with the upright elements, and respective plates which overlap, by mutual interengagement, the corresponding plates of the upright elements.

Thus, the metal structure can be adjusted both in width and height to accommodate the required dimensions.

After the structure has been adjusted to the desired dimensions, the entire assembly is secured together by screws.

Associated with the metal structure is a respective frame which is likewise adjustable in width and height and which includes a pair of frame posts having precut portions at the upper and lower ends thereof, as well as pair of upper angle members the vertical limbs of which are received in the frame posts while the horizontally directed limbs are fitted into one another. One of these horizontal limbs has precuts provided in it.

These and other features of the invention will readily be apparent from reading of the following detailed description of the preferred embodiment with reference to the accompanying drawings.

DESCRIPTION OF THE PREFERRED EMBODIMENT

Figure 1:
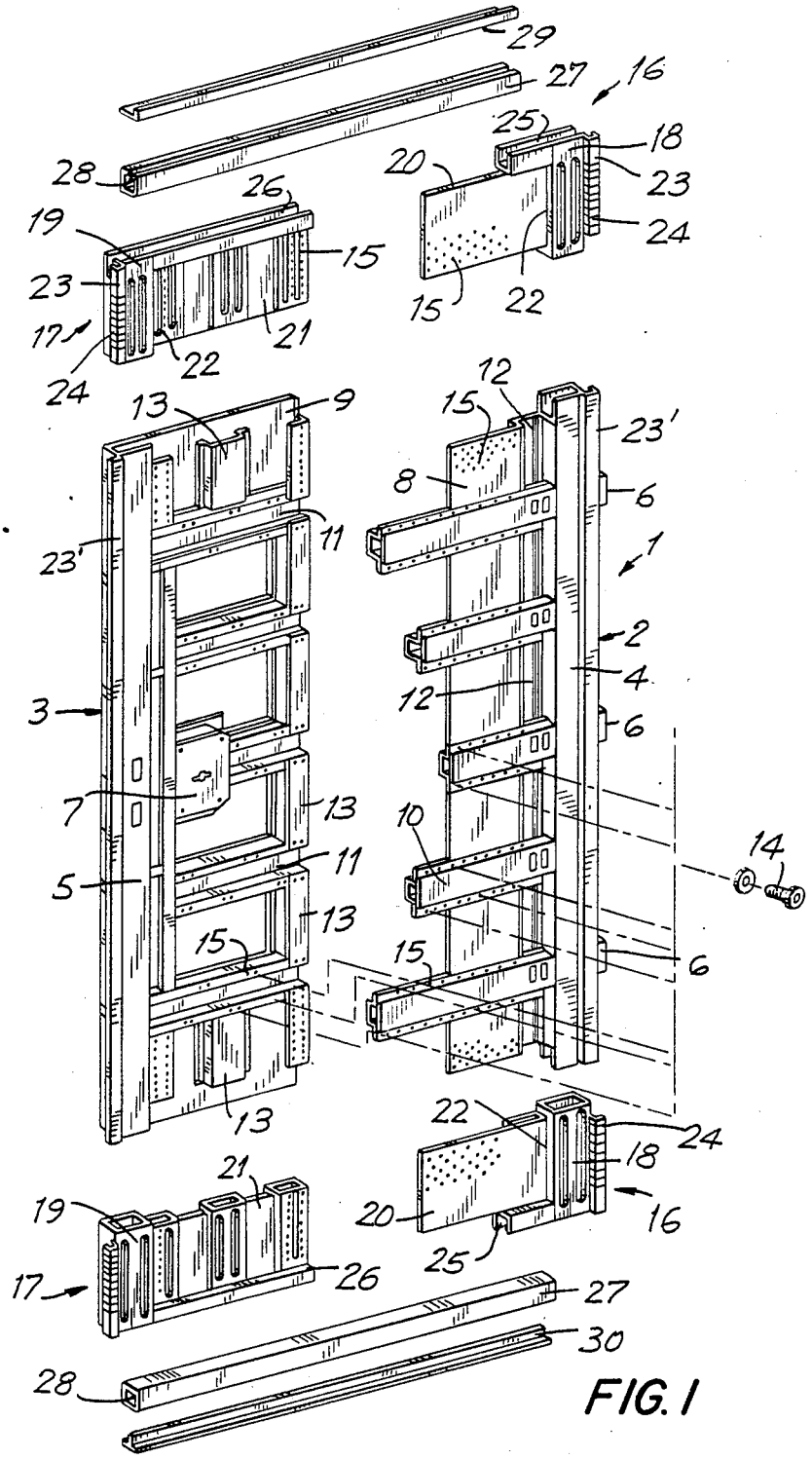
FIG. 1 is an exploded view of an adjustable structure for metal doors according to the invention.

In FIG. 1, reference numeral 1 designates an adjustable metal structure for a metal door according to the invention.

It essentially comprises two vertically extending upright elements 2 and 3 that include post members 4 and 5, respectively. The post member 4 carries hinges 6, and the post member 5 has at least one lock 7.

The elements 2 and 3 further include plates 8 and 9 respectively. The plates 8 and 9 are able to slide horizontally over one another so that a mutual interengagement takes place.

Cross-pieces 10 of different lengths are carried by the plate 8. The cross-pieces 10 are adapted to be received and to slide in a horizontal direction in corresponding grooved guides 11 carried by the plate 9. During this sliding movement, the plate 8 will at least in part overlap the plate 9.

Moreover, the plate 8 is further strengthened by the provision of a vertically extending rib 12 which is discontinued where the cross-pieces 10 are placed. The plate 9 is reinforced by similar ribs or hollow vertical protrusions 13.

The elements 2 and 3 can slidingly move horizontally with respect to one another from a position in which the cross-pieces 10 are entirely fitted in the corresponding grooved guides 11, to a position in which only the ends of the cross-pieces 10 protruding out of the plate 8, are fitted in the guides. Thereby an adjustment of width of the structure is obtained.

After the elements 2 and 3 have been adjusted to a position corresponding to the desired door width, they are firmly locked together by socket head screws 14 (only one shown in figure) which pass through respective registering holes 15 formed in the plates 8 and 9. Dotted regions in FIG. 1 show some of the holes 15 which can be made to accurately register for a given position of the elements 2 and 3.

At the top and the bottom of the elements 2 and 3, pairs of slides 16 and 17 are, respectively, provided.

Each slide 16 and 17 includes a post-piece 18, 19 which is received, in a vertically movable manner, in the post members 4 and 5 of the elements 2 and 3, respectively.

The slides 16 and 17 further include plates 20 and 21, respectively, which slide vertically relative to the corresponding uppermost and lowermost ends of the plates 8 and 9 to partially overlap the latter, as clearly shown in FIG. 1. To enable this vertical sliding movement, the plates 20 and 21 have slits 22 formed therein to provide for mutual telescoping of elements 16.2 and 17.3 respectively.

Moreover, each slide element is provided externally, along a vertical edge 23 thereof, with precut pieces 24, some of which may be removed according to the required amount of penetration of the slides into the elements 2 and 3. In this way, the edges 23 will constitute an extension of corresponding edges 23' provided on the post members 4 and 5 to serve as weather or sealing strip supports.

Arranged in mutual alignment on the external side of each slide 16 and 17 are U-shaped guides 25 and 26 which are secured to plates 20 and 21, respectively.

Obviously, the slides 16, 17 are also able to move in a horizontal direction relative to one another, with the associated plates 20 and 21 being in a partially overlapping relationship to one another.

The slides 16 and 17 are also fastened to the elements 2, 3, in order to complete the structure, by socket head screws 14 which pass through corresponding holes 15 which are registered with each other after assembling has been carried out.

The slides 16 and 17 are provided with U-shaped guides 25 and 26. A profile 27 is arranged in each of the guides. The profile 27 is provided with an outwardly directed longitudinal opening 28 designed to accommodate a seal strip channel 29 or a draught-guard strip 30 dependent on whether the profile 27 is at the top or the bottom of the metal structure 1.

The just described metal structure 1 is reversible. It can be turned over with respect to its position shown in FIG. 1 by reversing the positions of the upright elements 2 and 3 dependent on whether a right-hand or a left-hand-opening arrangement is desired.

Figure 2:
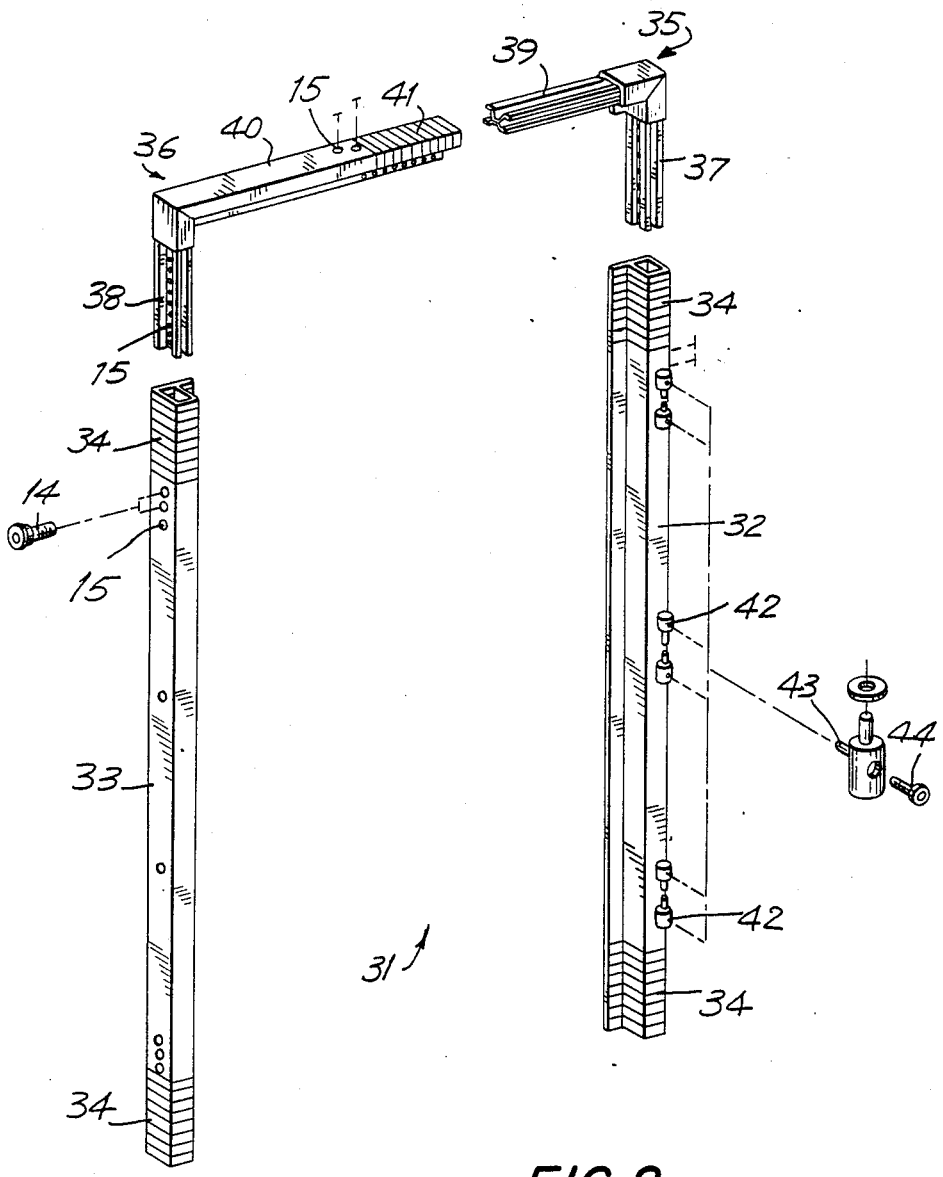
FIG. 2 is an exploded view of an adjustable frame for the metal structure shown in FIG. 1.

The adjustable frame associated with the structure 1, is shown in FIG. 2 and is designated generally by reference numeral 31.

It comprises two frame posts 32 and 33 which have precut regions at their top and bottom ends such that portions of the post may be removed therefrom for adjustment in height.

Arranged at the top of frame posts 32 and 33, are L-shaped angle members 35 and 36 the vertically extending limbs 37, 38 of which are received in the frame posts 32, 33, respectively, and the horizontally extending limbs 39, 40 of which are fitted into one another.

Adjustment in width is likewise obtained by removing precut portions 41 from the end of the horizontal limb 40 of the member 36 in which the limb 39 of the member 35 is received.

In this case too, the various elements are secured together by the socket head screws 14 (only one shown in FIG. 2) which pass through corresponding registered holes 15 formed in the two elements to be fastened to one another.

The frame post 32 also has a hinge 42 which are complementary to the hinge 6 of structure 1. The hinge 42, that are arranged in pairs, are secured to the frame post 32 by a spring pin 43 and a screw 44 (see FIG. 2).

Of course, first, the lower hinge 42 of each pair will be put in place and then, after it has been engaged with the complementary hinge 6 of structure 1, the upper hinge 42 will be secured to the frame post 32.

It should be apparent that the structure for metal doors and its associated frame according to the invention, are not limited to the specific embodiment described above and shown in the accompanying drawings, and a number of detail modifications may be made thereto as will be readily conceived by those skilled in the art, all of such modifications being intended to fall within the scope of this invention as defined in the appended claims.

I claim:

1. A metal door assembly comprising:

a pair of vertically extending post members, each post member including a flat vertical plate having at least one vertically extending reinforcing rib;

a plurality of cross-pieces projecting horizontally from one of said post members, the other of said post members having a plurality of horizontal guide grooves telescopically and slidably receiving said cross-pieces whereby said post members are able to move horizontally relative to one another;

upper and lower slides, each of said upper and lower slides including a pair of slide parts horizontally slidable relative to each other, each of said pair of slide parts being adapted to slide vertically relative to a respective post member and each of said pair of slide parts including a vertical post piece telescopically slidable relative to the respective post member, a horizontal post piece telescopically slidable relative to a horizontal post piece of another slide part, and a plate overlapping a plate of another slide part; and means for fixedly securing said post members and said slides relative to one another.

2. The metal door assembly defined in claim 1 wherein the vertical post pieces have removable stops vertically engageable with respective post member.

3. The metal door assembly defined in claim 1 wherein the horizontal post pieces of the upper and lower slides form upwardly and downwardly open channels, the slides each being provided in the respective channel with a horizontally throughgoing edge bar.

4. The metal door assembly defined in claim 1 wherein said flat vertical plates are formed with registering holes and said securing means includes screws engageable through these holes.

5. The metal door assembly defined in claim 1 wherein one of said post members is provided with hinges and the other of said post members is provided with a latch.

6. The metal door assembly defined in claim 1 wherein said post members and their cross-pieces and plates can be inverted and still fit together, whereby the door can be used right-handed or left-handed.

7. The metal door assembly defined in claim 1, further comprising:

a pair of vertical frame posts having precut and removable end sections;

a pair of L-shaped angle members having horizontally telescopable arms and vertical arms engageable in said frame posts, one of the horizontal arms having precut and removable end sections; and means for fixedly locking the frame posts and angle members together relative to one another in positions to fit around the door.

8. The metal door assembly defined in claim 7, further comprising hinges each having one half carried on one of said post members and another half carried on a respective frame post.

9. The metal door assembly defined in claim 8 wherein said hinge halves of said respective frame post is provided with an attachment screw and is removable by removal of the respective attachment screw.

10. The metal door assembly defined in claim 7 wherein said frame posts and angle members have registering holes, said locking means including screws passing through the holes.

* * * * *